US011019694B2

(12) United States Patent
Mai et al.

(10) Patent No.: US 11,019,694 B2
(45) Date of Patent: May 25, 2021

(54) APPARATUS AND METHOD FOR SIMULTANEOUSLY ADJUSTING BRIGHTNESS AND COLOR TEMPERATURE, AND LED LAMP

(71) Applicant: SHENZHEN SENDIS SEMICONDUCTOR CO., LTD, Shenzhen (CN)

(72) Inventors: Yanquan Mai, Shenzhen (CN); Xunsheng Deng, Shenzhen (CN); Bo Chen, Shenzhen (CN); Xiaoyu Chen, Shenzhen (CN); Wenpan Wang, Shenzhen (CN)

(73) Assignee: SHENZHEN SENDIS SEMICONDUCTOR CO., LTD, Shenzhen (CN)

( * ) Notice: Subject to any disclaimer, the term of this patent is extended or adjusted under 35 U.S.C. 154(b) by 0 days.

(21) Appl. No.: 16/644,628

(22) PCT Filed: May 25, 2018

(86) PCT No.: PCT/CN2018/088365
§ 371 (c)(1),
(2) Date: Mar. 5, 2020

(87) PCT Pub. No.: WO2019/047563
PCT Pub. Date: Mar. 14, 2019

(65) Prior Publication Data

US 2021/0068227 A1 Mar. 4, 2021

(30) Foreign Application Priority Data

Sep. 6, 2017 (CN) ..... 201710795203.8

(51) Int. Cl.
*H05B 45/10* (2020.01)
*H05B 45/31* (2020.01)
*H05B 45/20* (2020.01)

(52) U.S. Cl.
CPC ..... *H05B 45/31* (2020.01); *H05B 45/10* (2020.01); *H05B 45/20* (2020.01)

(58) Field of Classification Search
CPC ..... H05B 45/10; H05B 45/20; H05B 45/31; H05B 45/37; H05B 45/38; H05B 45/355;
(Continued)

(56) References Cited

U.S. PATENT DOCUMENTS 7,804,256 B2 * 9/2010 Melanson ..... H05B 45/38 315/291
9,860,958 B2 * 1/2018 Li ..... H05B 45/44
(Continued)

FOREIGN PATENT DOCUMENTS

CN 105592587 A 5/2016
CN 105657909 A 6/2016
(Continued)

OTHER PUBLICATIONS

International Search Report dated Aug. 21, 2018 in corresponding International application No. PCT/CN2018/088365; 5 pages.

*Primary Examiner* — Haissa Philogene
(74) *Attorney, Agent, or Firm* — Maier & Maier, PLLC

(57) ABSTRACT

An apparatus and method for simultaneously adjusting brightness and color temperature, and an LED lamp. The apparatus includes a phase control dimmer, a rectification module, a phase detection module, a current control module and an LED module. Cutting the phase of an input alternating current by the phase control dimmer changes the effective voltage of the alternating current, then the cut alternating current is rectified by the rectification module and output
(Continued)

to the LED module, thus adjusting the brightness of the LED module; information about the cut phase is detected by the phase detection module and a current control signal is output to a current control module according to the cut phase information, and the current control module controls change in the brightness ratio of mixed colors of the LED module according to the current control signal and adjusts the color temperature of the LED module.

12 Claims, 6 Drawing Sheets

(58) Field of Classification Search
CPC ..... H05B 47/10; H05B 47/11; H05B 45/345; H05B 45/3577; Y02B 20/30; Y02B 20/40
See application file for complete search history.

(56) References Cited

U.S. PATENT DOCUMENTS

| | | | | |
|---|---|---|---|---|
| 9,867,241 | B2 * | 1/2018 | Yeh | H05B 45/20 |
| 10,237,945 | B2 * | 3/2019 | Sooch | H05B 45/20 |
| 10,750,592 | B1 * | 8/2020 | Price | H05B 45/42 |
| 2008/0179497 | A1 | 7/2008 | Maniam et al. | |
| 2020/0022232 | A1 * | 1/2020 | Xiong | H05B 45/31 |

FOREIGN PATENT DOCUMENTS

| | | | |
|---|---|---|---|
| CN | 106804070 | A | 6/2017 |
| CN | 107580387 | A | 1/2018 |

* cited by examiner

APPARATUS AND METHOD FOR SIMULTANEOUSLY ADJUSTING BRIGHTNESS AND COLOR TEMPERATURE, AND LED LAMP

CROSS-REFERENCES TO RELATED APPLICATIONS

This application is a national stage application of PCT Patent Application No. PCT/CN2018/088365, filed on 25 May 2018, which claims priority to Chinese Patent Application No. 201710795203.8, filed on 6 Sep. 2017, the content of all of which is incorporated herein by reference.

FIELD

The present invention relates to the field of LED lightning, and more particularly, to an apparatus and a method for simultaneously adjusting brightness and color temperature, and a led lamp.

BACKGROUND

Although brightness and a color temperature are two irrelevant physical characters, a human eye will have different perceptions when receiving brightness and color temperatures of different LED lights, thus matching different brightness and color temperatures will obtain a plurality of different visual effects. However, in the prior art, when it is needed to achieve adjusting the brightness and the color temperature of an LED at a same time, there are still a plurality of aspects to be improved. For example, a method mentioned in CN201410729730.5 requires a key switch to select the color temperature, a triac dimmer to adjust the brightness, and only two types of the color temperature can be selected; also in a method described in CN201410240336.5, although the color temperature can be changed continuously, an adjustment depth is limited, and a bypass circuit has greatly increased a system power consumption.

Therefore, the current technology needs to be improved and developed.

SUMMARY

According to the above described defects, the purpose of the present invention is providing an apparatus and a method for simultaneously adjusting the brightness and the color temperature, and a led lamp, which changes the brightness of an LED module by a phase controlled dimmer cutting a phase of an input alternating current (AC), while at a same time, outputting a current control signal according to a phase cutting information before controlling a mixed brightness ratio of the LED module and achieving a synchronous adjustment for the color temperature, having a control circuit simple and a range wide of adjusting the color temperature, achieving a synchronous adjustment of the brightness and the color temperature without increasing an additional power consumption.

A technical solution of the present invention to solve the technical problems is as follows:

an apparatus for simultaneously adjusting brightness and a color temperature, wherein comprising a phase control dimmer, a rectification module, a phase detection module, a current control module and an LED module; changing an effective voltage of an alternating current by the phase control dimmer cutting a phase of an input alternating current, and rectifying the alternating current after being cut before outputting to the LED module by the rectification module, to adjust a brightness of the LED module; detecting a phase information after being cut through the phase detection module, and outputting a current control signal to the current control module according to the phase information after being cut, the current control module controls a change of a mixed color brightness proportion of the LED module according to the current control signal, to adjust a color temperature of the LED module.

The apparatus for simultaneously adjusting the brightness and the color temperature, wherein the phase detection module comprises a voltage sampling unit, a comparison unit, a timer, an arithmetic logic unit and a control signal converter; sampling an output voltage of the rectification module by the voltage sampling unit and setting a voltage detection threshold; comparing an output voltage of the rectification module to the voltage detection threshold by the comparison unit, before outputting an level signal correspondingly; counting and outputting a timing value by the timer, according to the level output by the comparison unit; calculating a current value of the LED module by the arithmetic logic unit according to the timing value; outputting a current control signal correspondingly to the LED module by the control signal converter according to the current value.

The apparatus for simultaneously adjusting the brightness and the color temperature, wherein the current control module comprises a first current control unit and a second current control unit; the LED module comprises a first LED lamps string and a second LED lamps string having the color temperature different; the arithmetic logic unit calculates respectively a current of the first LED lamps string and a current of the second LED lamps string according to the timing value, before converting into a first current control signal and a second current control signal by the control signal converter; the first current control unit and the second current control unit controls respectively a current in the first LED lamps string and a current in the second LED lamps string according to the first current control signal and the second current control signal, and controls the mixed color brightness proportion of the first LED lamp string and the second LED lamps string, to adjust the color temperature of the LED module.

The apparatus for simultaneously adjusting the brightness and the color temperature, wherein the comparison unit outputs a first level, when the output voltage of the rectification module is less than the voltage detection threshold; the comparison unit outputs a second level, when the output voltage of the rectification module is greater than the voltage detection threshold; the comparison unit outputs a second level; when an output level of the comparison unit changes from the second level to the first level, the timer is cleared before starting to count, and when the output level of the comparison unit changes from the first level to the second level, the timer stops counting and outputs the timing value.

The apparatus for simultaneously adjusting the brightness and the color temperature, wherein the voltage sampling unit comprises a first resistor, a second resistor and a first power source, one end of the first resistor connects to an input terminal of the rectification module, another end of the first resistor connects to one end of the second resistor and the comparison unit; another end of the second resistor connects to a negative electrode of the first power source and ground; a positive electrode of the first power source connects to the comparison unit; a voltage output from the first power source is the voltage detection threshold.

The apparatus for simultaneously adjusting the brightness and the color temperature, wherein the comparison unit comprises a comparator, a non-inverting input terminal of the comparator connects to another end of the first resistor, an inverting input terminal of the comparator connects to the positive electrode of the first power source, and an output terminal of the comparator connects to an input terminal of the timer.

The apparatus for simultaneously adjusting the brightness and the color temperature, wherein the first current control unit comprises a first operational amplifier, a first MOS transistor, and a third resistor; the second current control unit comprises a second operational amplifier, a second MOS transistor, and a fourth resistor; a first input terminal of the first operational amplifier connects to a first output terminal of the control signal converter, a second input terminal of the first operational amplifier connects to a source of the first MOS transistor, and gets grounded through the third resistor; an output terminal of the first operational amplifier connects to a gate of the first MOS transistor; a drain of the first MOS transistor connects to a negative electrode of the first LED lamps string;

a first input terminal of the second operational amplifier connects to a second output terminal of the control signal converter, a second input terminal of the second operational amplifier connects to a source of the second MOS transistor and gets grounded through the fourth resistor, an output terminal of the second operational amplifier connects to a gate of the second MOS transistor; a drain of the second MOS transistor connects to a negative electrode of the second LED string.

The apparatus for simultaneously adjusting the brightness and the color temperature, wherein the first current control unit comprises a third MOS transistor; the second current control unit comprises a fourth MOS transistor; a gate of the third MOS transistor connects to a first output terminal of the control signal converter, and a source of the third MOS transistor gets grounded, a drain of the third MOS transistor connects to the negative electrode of the first LED lamps string; a gate of the fourth MOS transistor connects to a second output terminal of the control signal converter, a source of the fourth MOS transistor gets grounded, and a drain of the fourth MOS transistor connects to the negative electrode of the second LED lamps string.

A method for simultaneously adjusting brightness and color temperature, wherein comprising following steps:

A, the phase control dimmer cuts the phase of the input alternating current and changes the effective voltage of the alternating current;

B, the rectification module rectifies the AC after being cut and outputs to the LED module, to adjust the brightness of the LED module;

C, the phase detection module detects the phase information after being cut, and outputs the current control signal according to the phase information after being cut;

D, the current control module controls a change of the mixed color brightness proportion of the LED module, according to the current control signal, to adjust the color temperature of the LED module.

An LED lamp, wherein comprising the apparatus for simultaneously adjusting the brightness and the color temperature as described above.

Comparing to the prior art, the present invention provides an apparatus and method for simultaneously adjusting the brightness and the color temperature and the LED lamp, wherein the apparatus for simultaneously adjusting the brightness and the color temperature comprises a phase control dimmer, a rectification module, a phase detection module, a current control module and a LED module. Changing an effective voltage of an alternating current by the phase control dimmer cutting a phase of an input alternating current, and rectifying the alternating current after being cut before outputting to the LED module by the rectification module, to adjust a brightness of the LED module; detecting a phase information after being cut through the phase detection module, and outputting a current control signal to the current control module according to the phase information after being cut, the current control module controls a change of a mixed color brightness proportion of the LED module according to the current control signal, to adjust a color temperature of the LED module; changing the brightness of the LED module by the phase control dimmer cutting the phase of the input alternating current, while outputting the current control signal to control the mixed color brightness proportion of the LED module according to the phase cutting information, to achieve a simultaneous adjustment of the color temperature, having a control circuit simple and a range of adjusting the color temperature wide, achieving a simultaneously adjustment for the brightness and the color temperature without increasing any additional power consumptions.

DETAILED DESCRIPTION OF EMBODIMENTS

According to a plurality of defects in the prior art, that it is impossible to achieve a simultaneous adjustment for the brightness and the color temperature in a convenient and fast way, with a low power consumption, the purpose of the present invention is providing an apparatus and a method for simultaneously adjusting the brightness and the color temperature, and a led lamp, which changes the brightness of an LED module by a phase controlled dimmer cutting a phase of an input AC, while at a same time, outputting a current control signal according to a phase cutting information before controlling a mixed brightness ratio of the LED module and achieving a synchronous adjustment for the color temperature, having a control circuit simple and a range wide of adjusting the color temperature, achieving a synchronous adjustment of the brightness and the color temperature without increasing an additional power consumption.

In order to make the purpose, technical solution and the advantages of the present invention clearer and more explicit, further detailed descriptions of the present invention are stated herein, referencing to the attached drawings and some preferred embodiments of the present invention. It should be understood that the detailed embodiments of the invention described here are used to explain the present invention only, instead of limiting the present invention.

Figure 1:
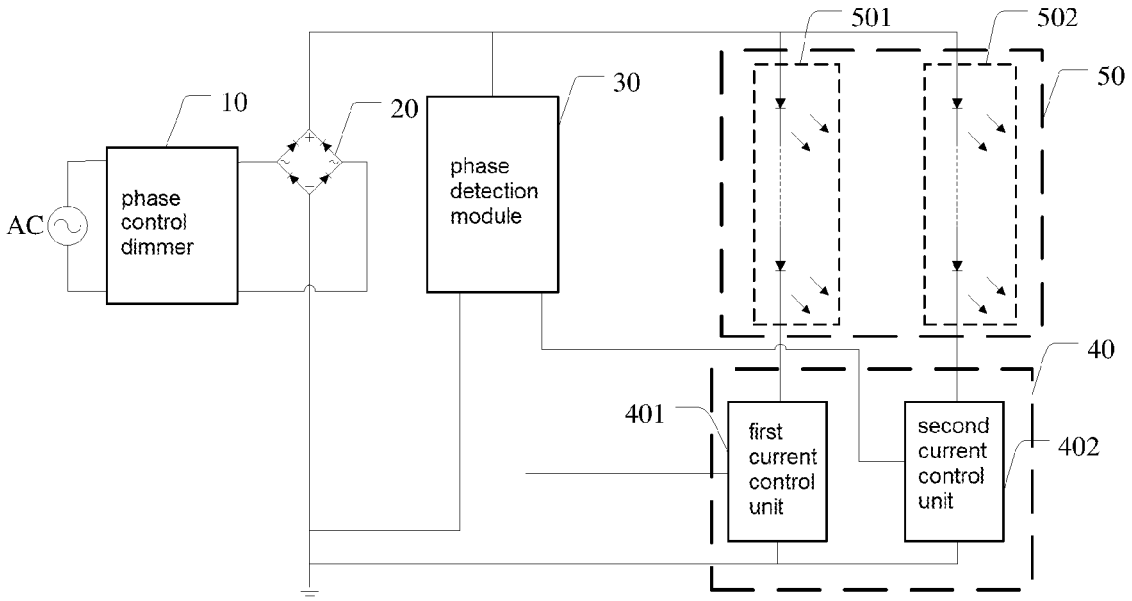
FIG. 1 illustrates a schematic circuit diagram of the apparatus for simultaneously adjusting the brightness and the color temperature provided in the present invention.

Referencing to FIG. 1, the apparatus for simultaneously adjusting the brightness and the color temperature comprises a phase control dimmer 10, a rectification module 20, a phase detection module 30, a current control module 40 and an LED module 50, an input terminal of the phase control dimmer 10 connects to an alternative current (AC) supplied, an output terminal of the phase control dimmer 10 connects to an input terminal of the rectification module 20, an output terminal of the rectification module 20 connects to an input terminal of the phase detection module 30 and the LED module 50, an output terminal of the phase detection module 30 further connects to the LED module 50 through the current control module 40.

Figure 2:
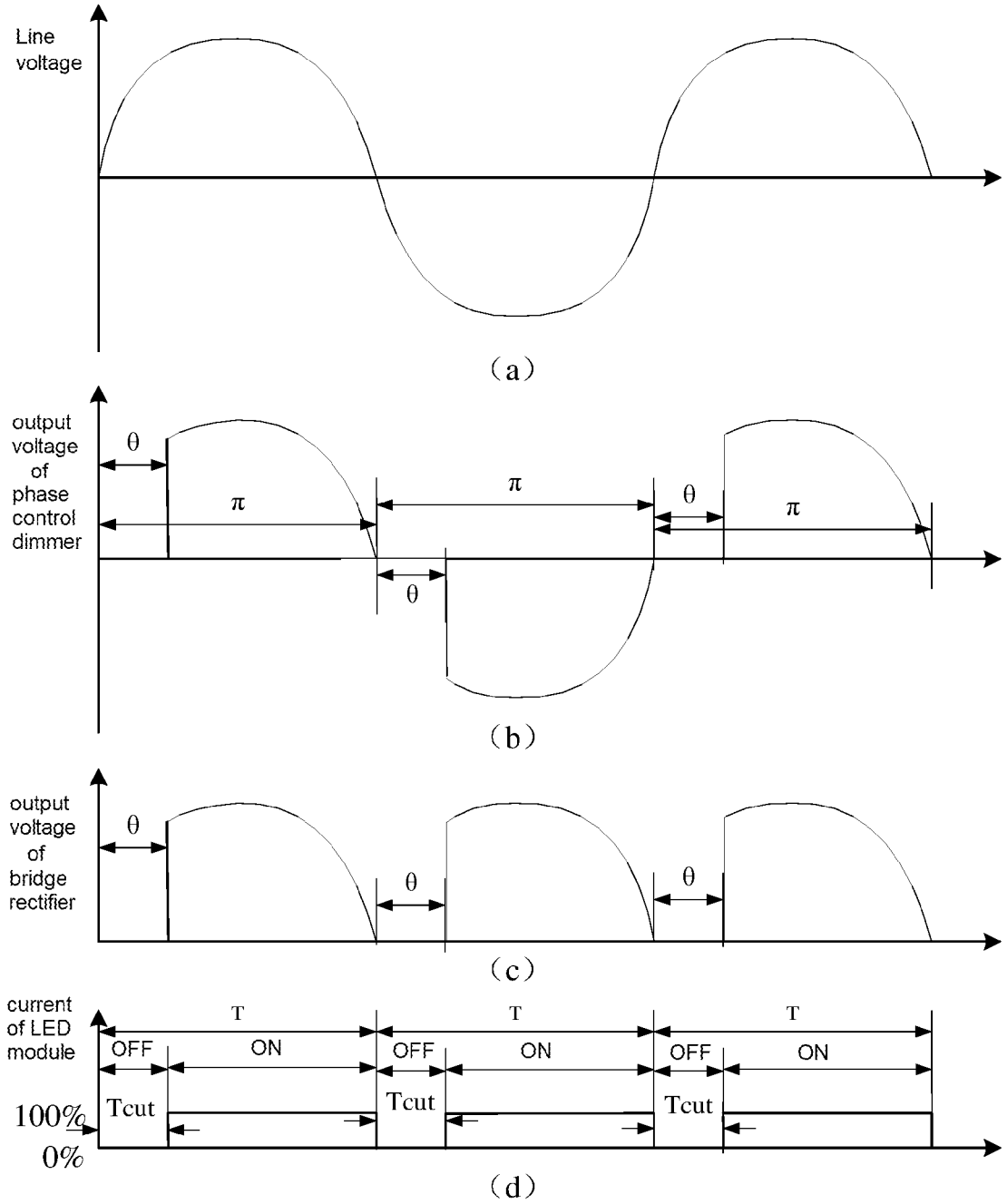
FIG. 2(*a*) 2(*d*) illustrates a schematic diagram of a phase cutting, an output voltage and an LED module current of the apparatus for simultaneously adjusting the brightness and the color temperature provided in the present invention.

Further referencing to FIG. 2, the present disclosure uses the phase control dimmer 10 to cut a phase of the input AC, and changes an effective voltage of the AC (shown as (a) (b) in FIG. 2, line voltage stands for the input voltage of the phase control dimmer), and the rectification module 20 makes a rectification process to the AC after being cut (as the (c) in FIG. 2) and outputs to the LED module 50, before driving an on-off state of the LED module 50 (as the (d) in FIG. 2), in the present embodiment, the rectification module 20 adopts a bridge rectifier, when a current of the LED module 50 is constant, by the phase control dimmer 10 cuts a phase of a sine wave, and changes an effective voltage of the LED module 50, it is possible to adjust a brightness of the LED module 50 directly, having a current structure simple, and achieving a brightness adjustment without requiring a power converter.

Also, the present disclosure further detects a phase information after being cut by the phase detection module 30, and outputs a current control signal to the current control module 40 according to a phase information after being cut, the current control module 40 controls a change of a mixed color brightness proportion of the LED module 50 according to the current control signal, to adjust the color temperature of the LED module 50. Thus a simultaneous adjustment of both the brightness and the color temperature can be achieved through a phase control dimmer 10.

In a real implementation, the current control module 40 comprises a first current control unit 401 and a second current control unit 402; the LED module 50 comprises a first LED lamps string 501 and a second LED lamps string 502, such as adopting a cold light LED lamps string and a warm light LED lamps string respectively, a first output terminal of the phase detection module 30 connects to the first LED lamps string 501 through the first current control unit 401, a second output terminal of the phase detection module 30 connects to the second LED lamps string 502 through the second current control unit 402, Comparing with a technique in the prior art that shunting one light string therein through a bypass circuit, wherein the bypass circuit will generate an additional power consumption, which may reach 50% in a worst case (only one light string is lit), while in the present disclosure, it is adopting a current source connected in serial with the LED lamps string to control the brightness, even only one lamp string is lit on, there is still no additional power consumption generated, thus realizing the brightness adjustment while achieving a purpose of saving energy as much as possible.

Figure 3:
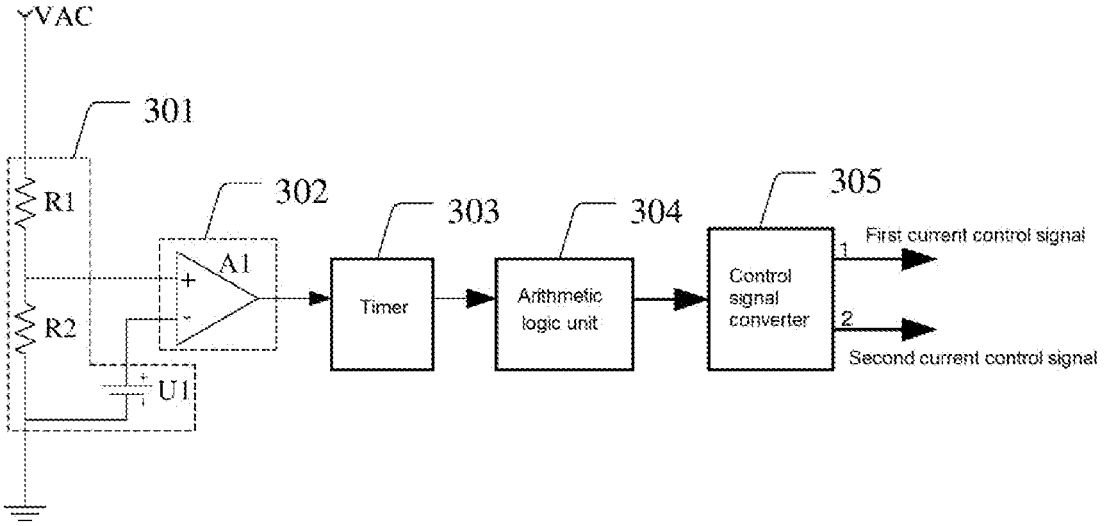
FIG. 3 illustrates a schematic circuit diagram of the phase detection module in the apparatus for simultaneously adjusting the brightness and the color temperature provided in the present invention.

Further, referencing to FIG. 3, the phase detection module 30 comprises a voltage sampling unit 301, a comparison unit 302, a timer 303, an arithmetic logic unit 304 and a control signal converter 305, an input terminal of the voltage sampling unit 301 connects to an output terminal of the rectification module 20, an output terminal of the voltage sampling unit 301 connects to an input end of the comparison unit 302, an output terminal of the comparison unit 302 connects to an input terminal of the control signal converter 305 through the timer 303 and the arithmetic logic unit 304, an output terminal of the control signal converter 305 connects to the current control module 40.

Sampling an output voltage of the rectification module 20 by the voltage sampling unit 301 and setting a voltage detection threshold, before the comparison unit 302 comparing the output voltage of the rectification module 20 to the voltage detection threshold, and outputting a level signal correspondingly according to a comparison result. The timer 303 starts counting according to the level signal before outputting a timing value to the arithmetic logic unit 304, followed by calculating a current value of the LED module 50 by the arithmetic logic unit 304 according to the timing value; and converting the current value into the current control signal correspondingly by the control signal converter 305, to control the change of the mixed color brightness proportion of the LED module 50, so as to realizing an adjustment for the color temperature of the LED module 50.

Specifically, a first output terminal of the current control module 40 connects to the first current control unit 401, and a second output terminal of the current control module 40 connects to the second current control unit 402. During a logic operation, the arithmetic logic unit 304 calculates respectively the current of the first LED light string 501 and the current of the second LED light string 502, according to the timing value, before being converted respectively into a first current control signal and a second current control signal by the control signal converter 305, and notifies the current control module 40 to change the current of the LED lamps string, the first current control unit 401 and the second current control unit 402 controls respectively the current in the first LED lamps string 501 and the current in the second LED lamps string 502 according to the first current control signal and the second current control signal, thus controlling the mixed color brightness proportion of the first LED lamps string 501 and the second LED light string 502 according to any requirements, so as to achieve an effect of adjusting the color temperature.

Preferably, the voltage sampling unit 301 comprises a first resistor R1, a second resistor R2 and a first power source U1, one end of the first resistor R1 connects to an input terminal of the rectification module 20, another end of the first resistor R1 connects to one end of the second resistor R2 and the comparison unit 302; another end of the second resistor R2 connects to a negative electrode of the first power source U1 and ground; a positive electrode of the first power source U1 connects to the comparison unit 302; a voltage output from the first power source U1 is the voltage detection threshold; the comparison unit 302 comprises a comparator A1, a non-inverting input terminal of the comparator A1 connects to another end of the first resistor R1, an inverting input terminal of the comparator A1 connects to the positive electrode of the first power source U1, and an output terminal of the comparator A1 connects to an Input terminal of the timer 303.

Figure 4:
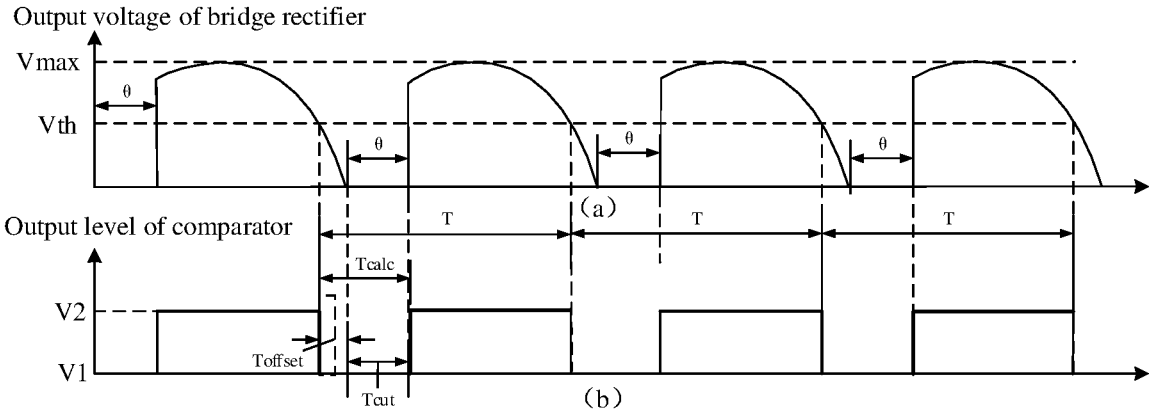
FIG. 4 illustrates a schematic diagram of the output voltage and the output level from the comparator in the apparatus for simultaneously adjusting the brightness and the color temperature provided in the present invention.

Referencing to FIG. 4 together, when the phase detection module 30 is working, sampling an output voltage VAC of the rectification module 20 by configuring the first resistor R1 and the second resistor R2, before outputting to the non-inverting input terminal of the comparator A1, while a voltage detection threshold Vth is output to the inverting input terminal of the comparator A1, and the comparator A1 compares the output voltage VAC of the rectification module 20 to the voltage detection threshold Vth, when the output voltage of the rectification module 20 is less than the voltage detection threshold, that is, VAC<Vth, the comparator A1 outputs a first level V1; when the output voltage of the rectification module 20 is greater than the voltage detection threshold, that is, VAC>Vth, the comparator A1 outputs a second level V2; in some embodiments, the comparator A1 compares the VAC*R2/(R1+R2) to the voltage detection threshold Vth, when the VAC*R2/(R1+R2) is less than the voltage detection threshold, that is, VAC*R2/(R1+R2)<Vth, the comparator A1 outputs a first level V1; when the VAC*R2/(R1+R2) is greater than the voltage detection threshold, that is, VAC*R2/(R1+R2)>Vth, the comparator A1 outputs a second level V2; when an output level of the comparator A1 changes from the second level V2 to the first level V1, the timer 303 is cleared before starting to count; and when the output level of the comparator A1 changes from the first level V1 to the second level V2, the timer 303 stops counting and outputs the timing value, and the timing value is Tcalc at the time, the arithmetic logic unit 304 calculates respectively each current of both LED lamps strings Iled1, Iled2, by a preset algorithm according to the Tcalc, before generating respectively a first current control signal and a second current control signal by the control signal converter 305, and outputting to the first current control unit 401 and the second current control unit 402 to control respectively the currents in both LED lamps strings, and realizing a color temperature adjustment by matching a brightness of both lamps strings having two color temperatures. Due to the lamps strings having different brightness and color temperatures can be controlled independently, thus all color temperatures between the color temperature 1 and the color temperature 2 may be achieved. Comparing to the prior art of CN201410240336.5, wherein a lamps string has current flowing through all the time, making a maximum adjustment range of the color temperature be between the color temperature 1 and (color temperature 1+color temperature 2)/2. Thus the color temperature in the present disclosure has a wide adjustment range, and a more applicable occasion.

In a real implementation, the preset algorithm of the arithmetic logic unit 304 may be designed different according to a different requirement, for example, when a first algorithm is designed to achieve a continuous change of the color temperature following the brightness, then the preset algorithm is: Iled1=Iint*Tcut/T; Iled2=Iint*(T−Tcut)/T. wherein Iint is a sum of the currents of both lamps strings when the input power source has no cutting, T is a period after an AC rectification, Tcut=Tcalc−Toffset; Toffset may be calculated by a trigonometric formula with the Vth and a Vmax.

A second algorithm is designed to keep a color temperature in a specific brightness range, then the preset algorithm is: if Tcalc<t1, then Iled1=I11, Iled2=I21, if t1<Tcalc<t2, then Iled1=I12, Iled2=I22; if t2<Tcalc<t3, then Iled1=I13, Iled2=I23; . . . , and so on.

A third is designed to keep the brightness unchanged, and the color temperature changing only, then the preset algorithm is: making a sum of the currents of both lamps strings Icut increase according to a decrease of the effective voltage, before adjusting a proportional relationship between the Iled1 and the Iled2 as needed. A formula of the Icut is as below:

$$Icut = Iint \times \sqrt{\frac{2\pi}{2\pi - 2\pi Tcut/T + \sin(2\pi Tcut/T)}}$$

0≤Tcut<T, and let Iled1=Icut*Tcut/T; Iled2=Icut*(T−Tcut)/T, then it is possible to achieve adjusting the color temperature only, without adjusting the brightness. Of course, three algorithms listed above are for examples only, and a user may design other algorithms according to an actual requirement, which is not limited in the present disclosure.

Further, the control signal converter 305 converts into a control signal for the current control module 40, according to the current values of the Iled1 and Iled2 calculated. In a real implementation, the control signal converter 305 may be a D/A (digital-to-analog) convertor, converting into a signal of an analog voltage or a signal of an analog current to control a current controller according to a calculated value of the Iled1 and the Iled2, or may be a PWM (pulse-width-modulation) convertor, converting into a PWM signal to control the current controller according to the calculated values of the Iled1 and the Iled2.

Figure 5:
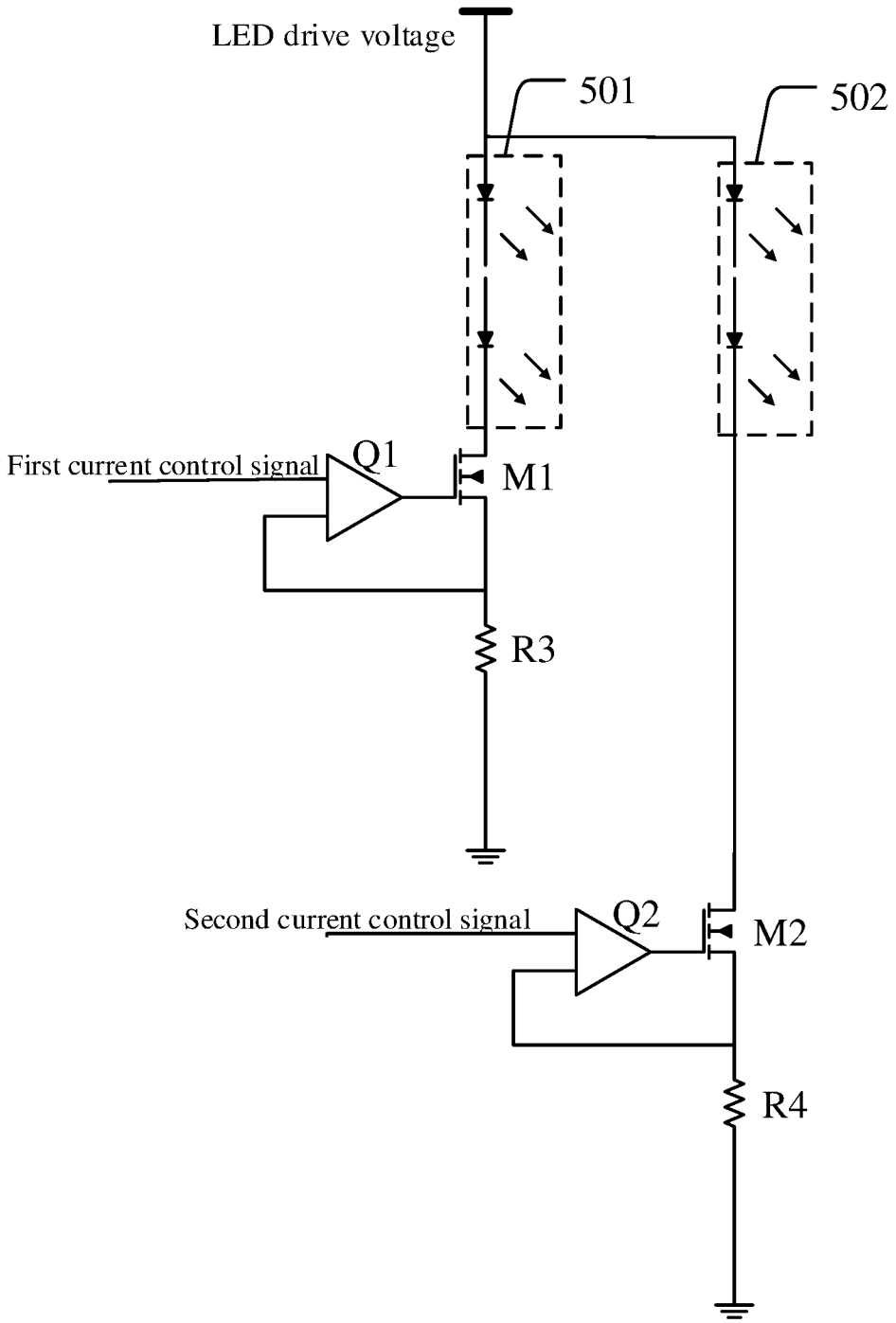
FIG. 5 illustrates a circuit diagram of the current control module in the first embodiment of the apparatus for simultaneously adjusting the brightness and the color temperature provided in the present invention.

Accordingly, the current control module 40 in the present disclosure provides two embodiments, shown as FIG. 5, in a first embodiment, the first current control unit 401 comprises a first operational amplifier Q1, a first MOS transistor M1, and a third resistor R3; the second current control unit 402 comprises a second operational amplifier Q2, a second MOS transistor M2, and a fourth resistor R4; a first input terminal of the first operational amplifier Q1 connects to a first output terminal of the control signal converter 305, a second input terminal of the first operational amplifier Q1 connects to a source of the first MOS transistor M1, and gets grounded through a third resistor R3; an output terminal of the first operational amplifier Q1 connects to a gate of the first MOS transistor M1; a drain of the first MOS transistor M1 connects to a negative electrode of the first LED lamps string 501;

a first input terminal of the second operational amplifier Q2 connects to a second output terminal of the control signal converter 305, a second input terminal of the second operational amplifier Q2 connects to a source of the second MOS transistor M2 and gets grounded through the fourth resistor R4, an output terminal of the second operational amplifier Q2 connects to a gate of the second MOS transistor M2; a drain of the second MOS transistor M2 connects to a negative electrode of the second LED string 502. That is, the control signal converter 305 herein is a D/A converter, converting the current value into the signal of the analog voltage before outputting to the first current control unit 401 and the second current control unit 402, then the first operational amplifier Q1 and the second operational amplifier Q2 control the currents of the first MOS transistor M1 and the second MOS transistor M2 according to the analog voltage input and the reference voltage input, so as to achieve a control to the current in the LED lamps string.

Figure 6:
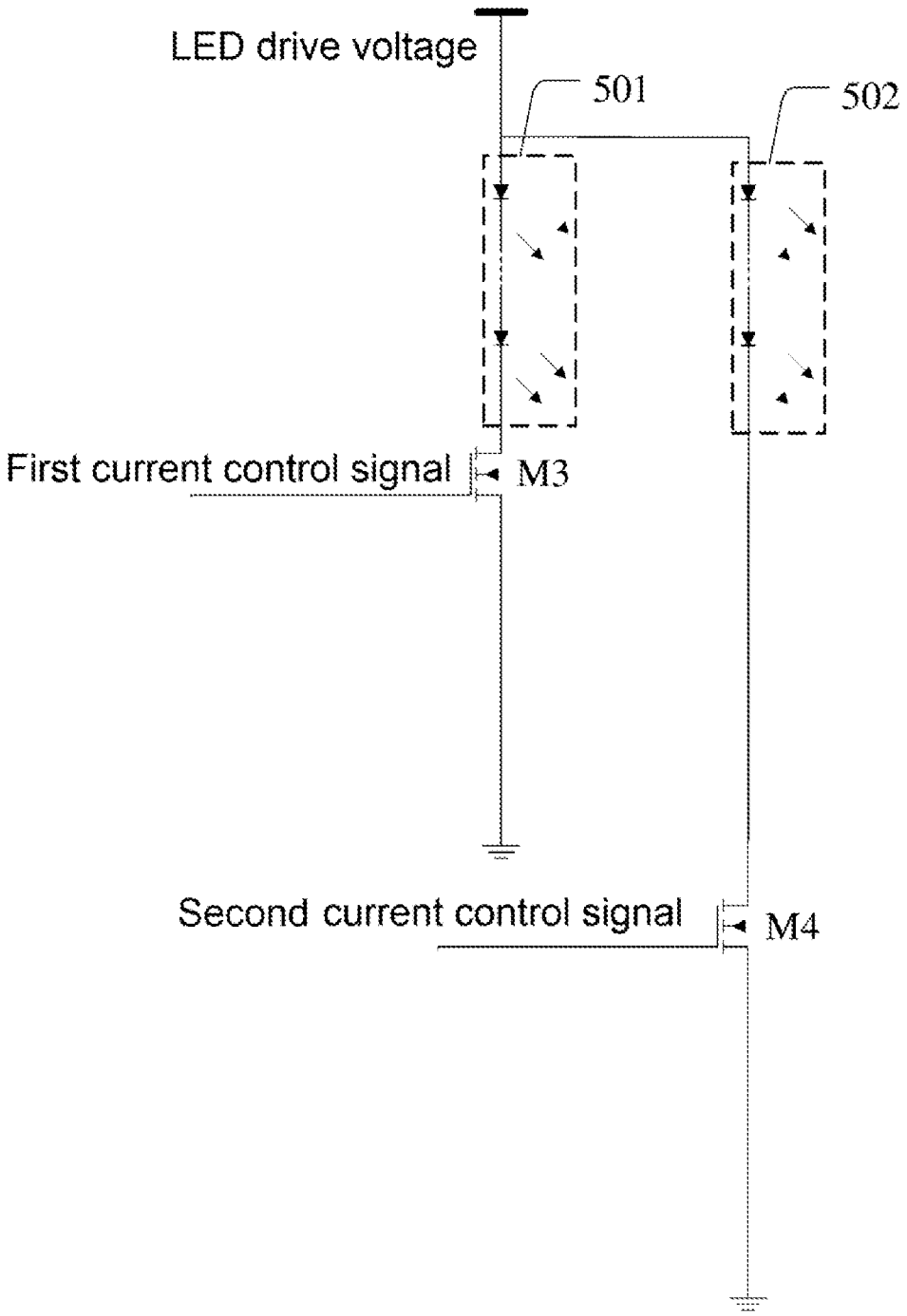
FIG. 6 illustrates a circuit diagram of the current control module in the second embodiment of the apparatus for simultaneously adjusting the brightness and the color temperature provided in the present invention.

Shown as FIG. 6, in a second embodiment, the first current control unit 401 comprises a third MOS transistor M3; the second current control unit 402 comprises a fourth MOS transistor M4; a gate of the third MOS transistor M3 connects to a first output terminal of the control signal converter 305, and a source of the third MOS transistor M3 gets grounded, a drain of the third MOS transistor M3 connects to the negative electrode of the first LED lamps string 501; a gate of the fourth MOS transistor M4 connects to a second output terminal of the control signal converter 305, and a source of the fourth MOS transistor M4 gets grounded, and a drain of the fourth MOS transistor M4 connects to the negative electrode of the second LED lamps string 502. That is, the control signal converter 305 herein is a PWM converter, converting the current value into a PWM signal before outputting to the current control module 40, controlling a switch of the third MOS transistor M3 and the fourth MOS transistor M4 by a duty cycle of the PWM signal, so as to control an average current in LED lamps strings.

Figure 7:
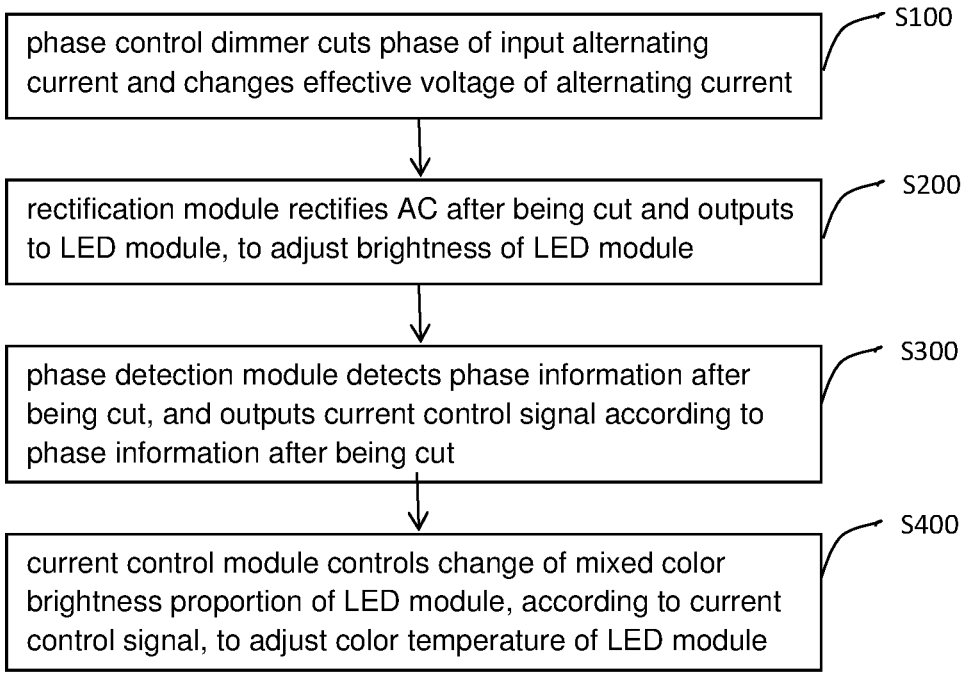
FIG. 7 illustrates a flow chart of the method for simultaneously adjusting the brightness and the color temperature provided in the present invention.

The present disclosure further provides a method for simultaneously adjusting brightness and color temperature, shown as FIG. 7, the method for simultaneously adjusting brightness and color temperature comprises following steps:

S100, the phase control dimmer cuts the phase of the input alternating current and changes the effective voltage of the alternating current;

S200, the rectification module rectifies the AC after being cut and outputs to the LED module, to adjust the brightness of the LED module;

S300, the phase detection module detects the phase information after being cut, and outputs the current control signal according to the phase information after being cut;

S400, the current control module controls a change of the mixed color brightness proportion of the LED module, according to the current control signal, to adjust the color temperature of the LED module.

Details may reference to the embodiments of the apparatus above.

The present disclosure further provides an LED lamp, being able to simultaneously adjusting the brightness and the color temperature, wherein comprising the apparatus for simultaneously adjusting the brightness and the color temperature as described above. Since the apparatus for simultaneously adjusting the brightness and the color temperature has been described in details above, no more details will be described herein.

All above, the present disclosure provides an apparatus and method for simultaneously adjusting the brightness and the color temperature and the LED lamp, wherein the apparatus for simultaneously adjusting the brightness and the color temperature comprises a phase control dimmer, a rectification module, a phase detection module, a current control module and a LED module. Changing an effective voltage of an alternating current by the phase control dimmer cutting a phase of an input alternating current, and rectifying the alternating current after being cut before outputting to the LED module by the rectification module, to adjust a brightness of the LED module; detecting a phase information after being cut through the phase detection module, and outputting a current control signal to the current control module according to the phase information after being cut, the current control module controls a change of a mixed color brightness proportion of the LED module according to the current control signal, to adjust a color temperature of the LED module; changing the brightness of the LED module by the phase control dimmer cutting the phase of the input alternating current, while outputting the current control signal to control the mixed color brightness proportion of the LED module according to the phase cutting information, to achieve a simultaneous adjustment of the color temperature, having a control circuit simple and a range of adjusting the color temperature wide, achieving a simultaneously adjustment for the brightness and the color temperature without increasing any additional power consumptions.

It should be understood that, the application of the present invention is not limited to the above examples listed. Ordinary technical personnel in this field can improve or change the applications according to the above descriptions, all of these improvements and transforms should belong to the scope of protection in the appended claims of the present invention.

What is claimed is:

1. An apparatus for simultaneously adjusting brightness and a color temperature, comprising:

a phase control dimmer, a rectification module, a phase detection module, a current control module and an LED module; wherein the phase control dimmer is configured to change an effective voltage of an alternating current by cutting a phase of an input alternating current, and the rectification module is configured to rectify the alternating current after being cut before outputting to the LED module, to adjust a brightness of the LED module; the phase detection module is configured to detect phase information after being cut through, the phase detection module further configured to output a current control signal to the current control module according to the phase information after being cut, wherein the current control module is configured to control a change of a mixed color brightness proportion of the LED module according to the current control signal, to adjust a color temperature of the LED module.

2. The apparatus for simultaneously adjusting the brightness and the color temperature according to claim 1, wherein the phase detection module comprises a voltage sampling unit, a comparison unit, a timer, an arithmetic logic unit and a control signal converter; the voltage sampling module is configured to sample an output voltage of the rectification module and seta voltage detection threshold; the comparison unit is configured to compare an output voltage of the rectification module to the voltage detection threshold before outputting an level signal correspondingly; the timer is configured to count and output a timing value according to the level output by the comparison unit; the arithmetic logic unit is configured to calculate a current value of the LED module unit according to the timing value; and the control signal converter is configured to output a current control signal, correspondingly to the LED module according to the current value.

3. The apparatus for simultaneously adjusting the brightness and the color temperature according to claim 2, wherein the current control module comprises a first current control unit and a second current control unit; the LED module comprises a first LED lamps string and a second LED lamps string having different color temperatures; the arithmetic logic unit is configured to calculate, respectively, a current of the first LED lamps string and a current of the second LED lamps string according to the timing value, before converting into a first current control signal and a second current control signal by the control signal converter; the first current control unit and the second current control unit are then configured to control, respectively, a current in the first LED lamps string and a current in the second LED lamps string according to the first current control signal and the second current control signal, and control the mixed color brightness proportion of the first LED lamp string and the second LED lamps string; to adjust the color temperature of the LED module.

4. The apparatus for simultaneously adjusting the brightness and the color temperature according to claim 2, wherein the comparison unit is configured to output a first level when the output voltage of the rectification module is less than the voltage detection threshold; the comparison unit is configured to output a second level when the output voltage of the rectification module is greater than the voltage detection threshold; when an output level of the comparison unit changes from the second level to the first level, the timer is configured to clear before starting to count, and when the output level of the comparison unit changes from the first level to the second level, the timer is configured to stop counting and output the timing value.

5. The apparatus for simultaneously adjusting the brightness and the color temperature according to claim 4, wherein the voltage sampling unit comprises a first resistor, a second resistor and a first power source, one end of the first resistor connects to an input terminal of the rectification module, another end of the first resistor connects to one end of the second resistor and the comparison unit; another end of the second resistor connects to a negative electrode of the first power source and ground; a positive electrode of the first power source connects to the comparison unit; and a voltage output from the first power source is the voltage detection threshold.

6. The apparatus for simultaneously adjusting the brightness and the color temperature according to claim 5, wherein the comparison unit is configured to output a first level when a divided voltage of the output voltage on the second resistor is less than the voltage detection threshold; the comparison unit outputs a second level when the divided voltage of the output voltage on the second resistor is greater than the voltage detection threshold; when an output level of the comparison unit changes from the second level to the first level, the timer is configured to be cleared before starting to count, and when the output level of the comparison unit changes from the first level to the second level, the timer is configured to stop counting and output the timing value.

7. The apparatus for simultaneously adjusting the brightness and the color temperature according to claim 2, wherein the voltage sampling unit comprises a first resistor, a second resistor and a first power source, one end of the first resistor connects to an input terminal of the rectification module, another end of the first resistor connects to one end of the second resistor and the comparison unit; another end of the second resistor connects to a negative electrode of the first power source and ground; a positive electrode of the first power source connects to the comparison unit; and a voltage output from the first power source is the voltage detection threshold.

8. The apparatus for simultaneously adjusting the brightness and the color temperature according to claim 7, wherein the comparison unit comprises a comparator, a non-inverting input terminal of the comparator connects to another end of the first resistor, an inverting input terminal of the comparator connects to the positive electrode of the first power source, and an output terminal of the comparator connects to an input terminal of the timer.

9. The apparatus for simultaneously adjusting the brightness and the color temperature according to claim 3, wherein the first current control unit comprises a first operational amplifier, a first MOS transistor, and a third resistor; the second current control unit comprises a second operational amplifier, a second MOS transistor, and a fourth resistor; a first input terminal of the first operational amplifier connects to a first output terminal of the control signal converter, a second input terminal of the first operational amplifier connects to a source of the first MOS transistor and gets grounded through the third resistor; an output terminal of the first operational amplifier connects to a gate of the first MOS transistor; a drain of the first MOS transistor connects to a negative electrode of the first LED lamps string; a first input terminal of the second operational amplifier connects to a second output terminal of the control signal converter, a second input terminal of the second operational amplifier connects to a source of the second MOS transistor and gets grounded through the fourth resistor, an output terminal of the second operational amplifier connects to a gate of the second MOS transistor; and a drain of the second MOS transistor connects to a negative electrode of the second LED string.

10. The apparatus for simultaneously adjusting the brightness and the color temperature according to claim 3, wherein the first current control unit comprises a third MOS transistor; the second current control unit comprises a fourth MOS transistor; a gate of the third MOS transistor connects to a first output terminal of the control signal converter, and a source of the third MOS transistor is grounded, a drain of the third MOS transistor connects to the negative electrode of the first LED lamps string; a gate of the fourth MOS transistor connects to a second output terminal of the control signal converter, a source of the fourth MOS transistor is grounded, and a drain of the fourth MOS transistor connects to the negative electrode of the second LED lamps string.

11. A method for simultaneously adjusting brightness and a color temperature, comprising the following steps:

cutting a phase of an input alternating current and changing an effective voltage of an alternating current;

rectifying an alternating current after being cut and outputting to an LED module, to adjust a brightness of the LED module;

detecting a phase information after being cut, and outputting a current control signal according to the phase information after being cut; and controlling a change of a mixed color brightness proportion of the LED module, according to the current control signal, to adjust the color temperature of the LED module.

12. An LED lamp, the LED lamp comprising an apparatus for simultaneously adjusting the brightness and the color temperature, including a phase control dimmer, a rectification module, a phase detection module, a current control module and an LED module; wherein the phase control dimmer is configured to change an effective voltage of an alternating current by cutting a phase of an input alternating current, and the rectification module is configured to rectify the alternating current after being cut before outputting to the LED module to adjust a brightness of the LED module; the phase detection module is configured to detect a phase information after being cut through and output a current control signal to the current control module according to the phase information after being cut, the current control module is configured to control a change of a mixed color brightness proportion of the LED module according to the current control signal, to adjust a color temperature of the LED module.

* * * * *